US007146993B2

(12) United States Patent
Williams et al.

(10) Patent No.: US 7,146,993 B2
(45) Date of Patent: Dec. 12, 2006

(54) BRACKET FOR DISHWASHER TUB

(75) Inventors: Jeffrey N. Williams, Jackson, TN (US); J. Don Milam, Sugartree, TN (US); Dwight M. Turner, Hillsboro, OR (US); Daniel Hruby, Jackson, TN (US)

(73) Assignee: Maytag Corporation, Newton, IA (US)

( * ) Notice: Subject to any disclaimer, the term of this patent is extended or adjusted under 35 U.S.C. 154(b) by 473 days.

(21) Appl. No.: 10/410,943

(22) Filed: Apr. 10, 2003

(65) Prior Publication Data

US 2004/0200507 A1 Oct. 14, 2004

(51) Int. Cl.
*B08B 3/00* (2006.01)

(52) U.S. Cl. ..... 134/113; 134/57 D; 134/95.3; 134/98.1; 134/56 D; 134/63; 134/105; 134/106; 134/107

(58) Field of Classification Search ..... 134/113, 134/57 D, 95.3, 98.1, 56 D, 63, 105, 106, 134/107; 337/354, 356
See application file for complete search history.

(56) References Cited

U.S. PATENT DOCUMENTS 3,827,013 A 7/1974 Kowalski et al.
3,911,247 A * 10/1975 Rowe ..... 392/441
4,159,211 A 6/1979 Hoffman et al.
4,279,384 A 7/1981 Yamamoto
4,297,668 A 10/1981 Place
4,399,971 A 8/1983 Fehrmann et al.
4,446,450 A 5/1984 Boulanger et al.
4,446,451 A 5/1984 Boulanger
4,653,708 A 3/1987 Rich
4,657,215 A 4/1987 Murphy
5,011,101 A 4/1991 Buchser
5,678,281 A * 10/1997 Kamp et al. ..... 24/3.11
6,417,758 B1 * 7/2002 Russell et al. ..... 337/380
6,507,267 B1 1/2003 Russell et al.

* cited by examiner

*Primary Examiner*—Michael Barr
*Assistant Examiner*—Rita R. Patel
(74) *Attorney, Agent, or Firm*—McKee, Voorhees & Sease, P.L.C.

(57) ABSTRACT

A bracket is provided for mounting an object to a tub of a dishwasher. The bracket is mounted on the annulus edge of the pump opening in the bottom of the tub adjacent the pump seal ring. No other fasteners are used to secure the bracket to the tub. The bracket is mounted on the tub before the pump is installed. In one embodiment a thermostat is pivotally mounted on the bracket so as to maintain substantially flush engagement with the tub. In a second embodiment, a wire harness extends through a loop of the bracket for support adjacent the tub.

7 Claims, 7 Drawing Sheets

BRACKET FOR DISHWASHER TUB

BACKGROUND OF THE INVENTION

Dishwashers generally include a tub which defines the washing chamber, and a door pivotal between open and closed positions. A pump is installed in the bottom of the tub and normally extends through a hole in the bottom of the tub, with a sealing ring extending around the edge or annulus of the hole between the pump and the tub. Other components of the dishwasher are positioned in the dishwasher cabinet, beneath the tub. Mounting of these components raises certain concerns.

For example, dishwashers typically include a thermostat to sense the temperature of the tub in the event the heater does not turn off. The thermostat is wired in series with the heater and breaks the circuit in the event of over temperature. It is important that the thermostat engage the tub in a flush or flat orientation for proper functioning of the thermostat. Typically, the thermostat is rigidly mounted to the tub with a bracket assembly. However, such rigid construction may lead to problems with insufficient contact between the thermostat and the tub. Therefore, it is desirable to provide a mounting bracket and method for mounting the thermostat which assures flush engagement of the thermostat with the tub, both at the time of installation and throughout the life of the dishwasher.

Wire harnesses extending from the control panel of the dishwasher to the main pump and other electronically powered components also reside beneath the tub in the dishwasher cabinet. In dishwashers having a plastic tub, the wire harness is often routed along the bottom of the tub through holes in flanges on the tub bottom, to prevent dangling wires form being caught during production assembly or installation in the home, or service work. However, such molded flanges are not possible in a dishwasher having a stainless steel tub.

Accordingly, a primary objective of the present invention is the provision of a bracket which can be quickly and easily mounted on the annulus of the tub for supporting various lightweight components of the dishwasher.

Another objective of the present invention is the provision of a bracket which clips onto the tub annulus without the use of additional fasteners.

Accordingly, a primary objective of the present invention is an improved thermostat bracket for mounting a thermostat to a dishwasher tub.

A further objective of the present invention is the provision of a thermostat bracket which pivotally mounts the thermostat to the tub so as to assure flush contact between the thermostat and the tub.

Another objective of the present invention is the provision of a dishwasher thermostat bracket which is resilient and flexible so as to apply a force to the thermostat to maintain contact between the thermostat and the dishwasher tub.

A further objective of the present invention is the provision of a method of mounting the thermostat to the dishwasher tub to assure flush engagement between the thermostat and the tub.

Another objective of the present invention is the provision of a method of clipping a thermostat to a dishwasher tub using a bracket without additional fasteners.

Another objective of the present invention is the provision of a method of installing a thermostat bracket assembly to a dishwasher tub before the pump is installed in the tub.

Yet another objective of the present invention is the provision of a method of clipping a bracket to the tub annulus for holding lightweight components without the use of other fasteners.

Another objective of the present invention is the provision of a method of installing a thermostat and bracket assembly to the pump seal ring on a dishwasher tub.

Still another objective of the present invention is the provision of a bracket which mounts onto the tub annulus for holding a wire harness.

These and other objectives will become apparent from the following description of the invention.

SUMMARY OF THE INVENTION

The present invention is directed towards a bracket which can be quickly and easily clipped onto the annulus of the tub adjacent the pump seal ring for mounting various lightweight components to the tub of the dishwasher. The bracket is clipped onto the tub annulus without the use of additional fasteners, such that installation is quick and easy. The bracket is resilient and flexible, and may be made of metal, plastic, or other suitable material.

In one embodiment, the bracket is used in a dishwasher thermostat assembly mounted on an edge of the tub adjacent the pump seal ring, with a thermostat pivotally mounted on the bracket for flush engagement with the tub. The bracket includes a clip for mounting the bracket to the edge of the tub. The bracket is flexible or resilient so as to apply a force to the thermostat to maintain contact between the thermostat and the tub. The bracket may be coated with an insulative material to prevent metal-to-metal contact between the bracket and the tub. Alternatively, an insulating disk may be provided between the bracket and the tub to prevent metal-to-metal contact. A bead is provided on the bracket or the insulator disk and engages a portion of the thermostat so as to define a pivot axis for the thermostat, and thereby maintain flush engagement between the bracket and the tub. In a second embodiment, the bracket supports a wire harness on the tub adjacent the annulus. The bracket includes a notch to quickly and easily guide the harness into the retention loop of the bracket.

In the method of the present invention, the bracket simply clips to the tub annulus, without the use of other fasteners. In the first embodiment, the thermostat assembly is mounted to the tub by inserting the thermostat into a hole in the bracket and clipping the bracket onto the edge of the tub adjacent the pump seal ring. The pump is then installed into the tub. The pivotal mounting of the thermostat on the bracket allows the thermostat to pivot relative to the bracket and thereby provide substantially flush engagement between the thermostat and the tub. The bracket is the only hardware used to mount the thermostat to the tub. In the second embodiment, the wire harness is quickly and easily installed in the loop of the bracket before or after the bracket is installed on the tub.

DETAILED DESCRIPTION OF THE DRAWINGS

Figure 1:
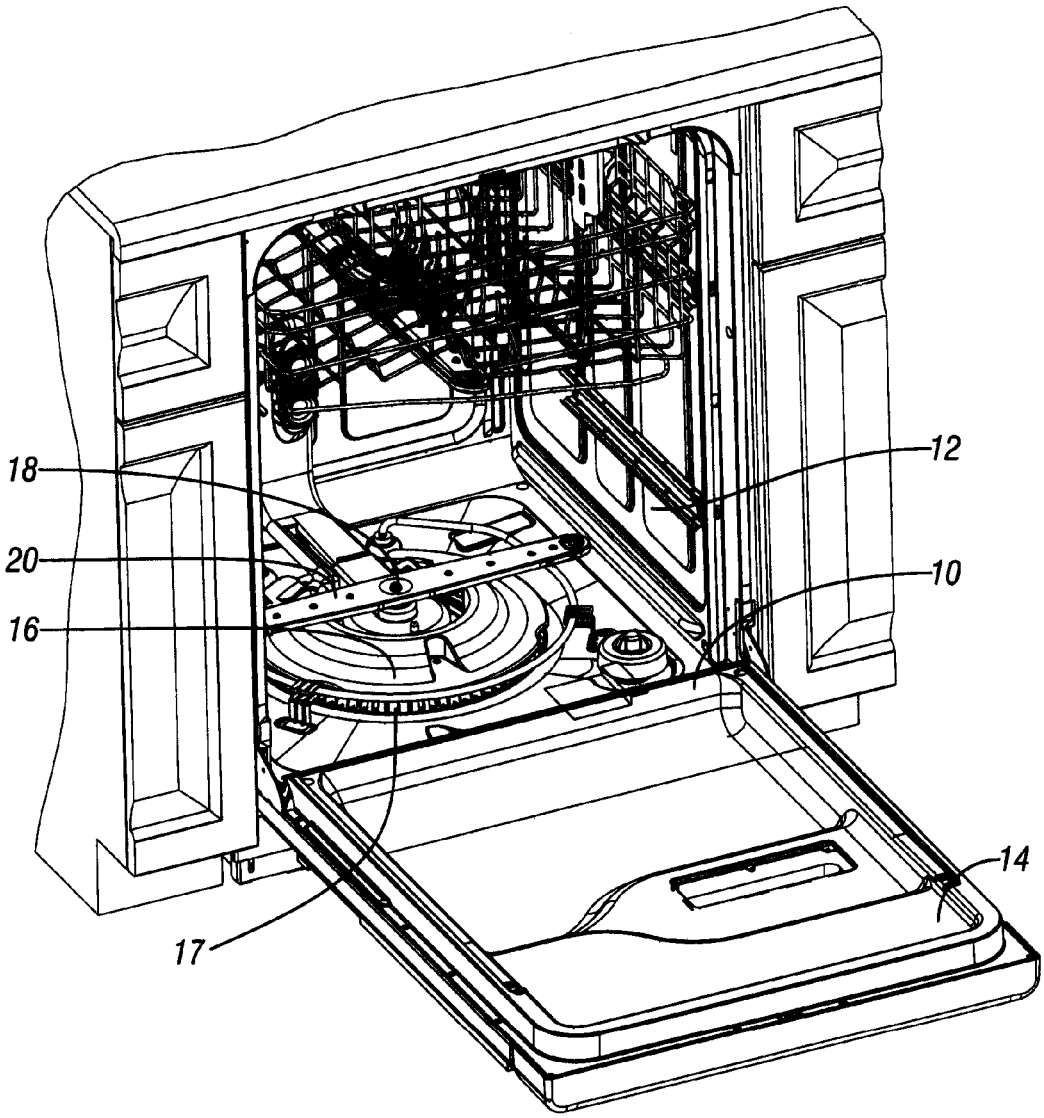
FIG. 1 is a perspective view of a dishwasher with the door open and showing the pump mounted in the bottom of the tub.
Figure 2:
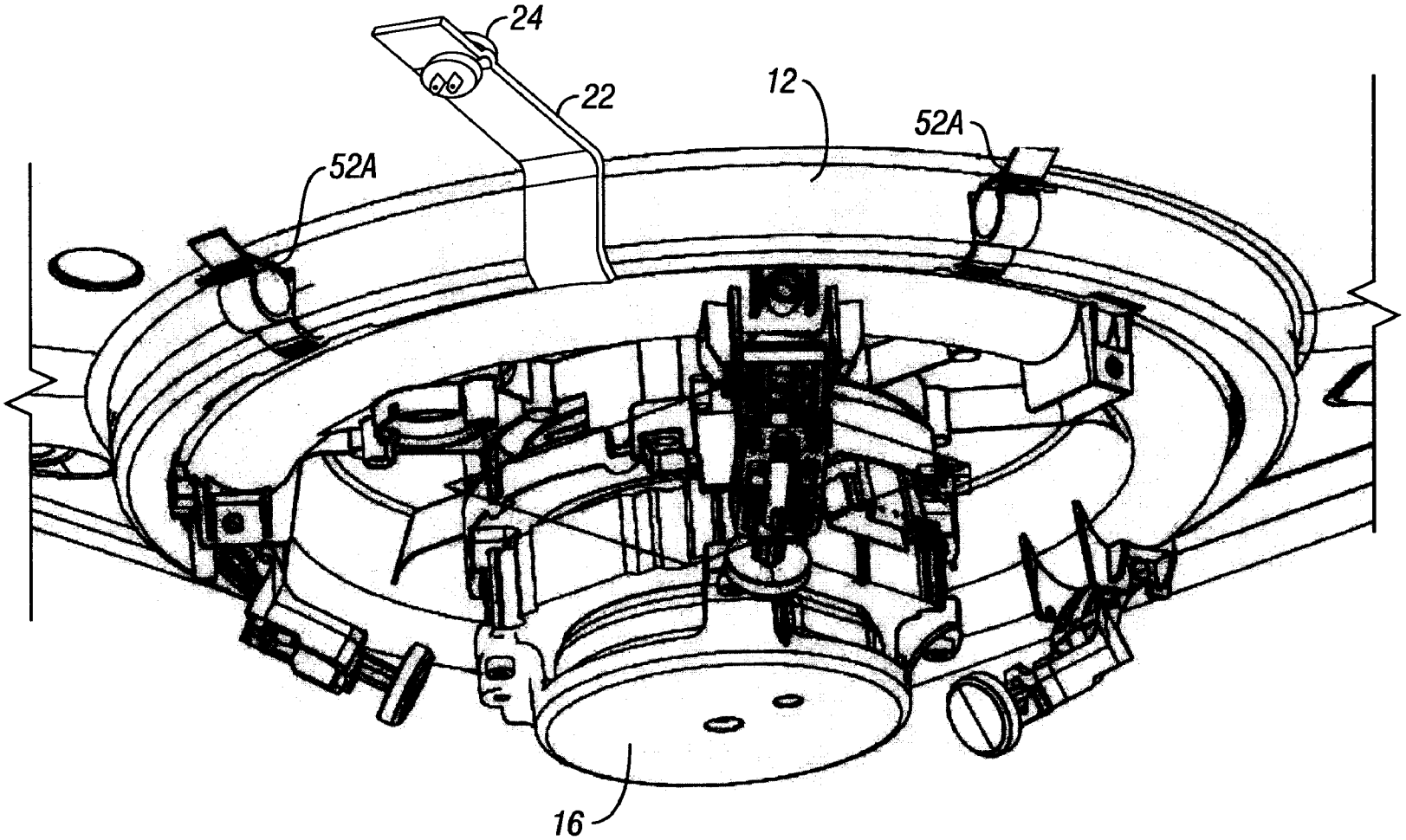
FIG. 2 is a perspective view of the dishwasher tub with the pump mounted therein and the brackets of the present invention.

In FIG. 1, a dishwasher is generally designated by the reference numeral 10. The dishwasher includes a tub 12 defining a washing chamber and a door 14 pivotal between the open position shown in FIG. 1 and a closed position. A pump 16 is mounted in an opening 17 in the bottom of the tub 12, as best seen in FIG. 2. A pump seal ring (not shown) provides sealing engagement between the tub 12 and the pump 16. A water hub 18 extends upwardly from the pump 16 and has a rotatable spray arm 20 mounted on the hub 18.

The above structures of the dishwasher 10 are conventional, and do not constitute a part of the present invention.

Figure 3:
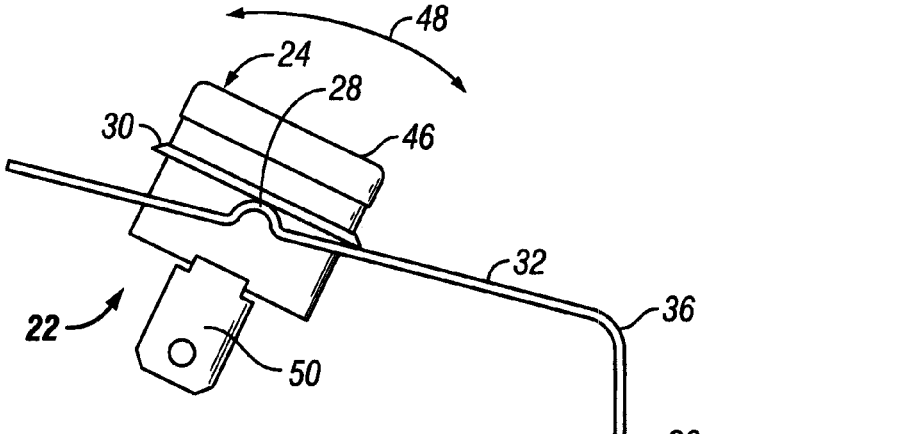
FIGS. 3 and 4 are side elevation views of the thermostat assembly showing alternative pivotal orientations of the thermostat relative to a first mounting bracket embodiment.
Figure 4:
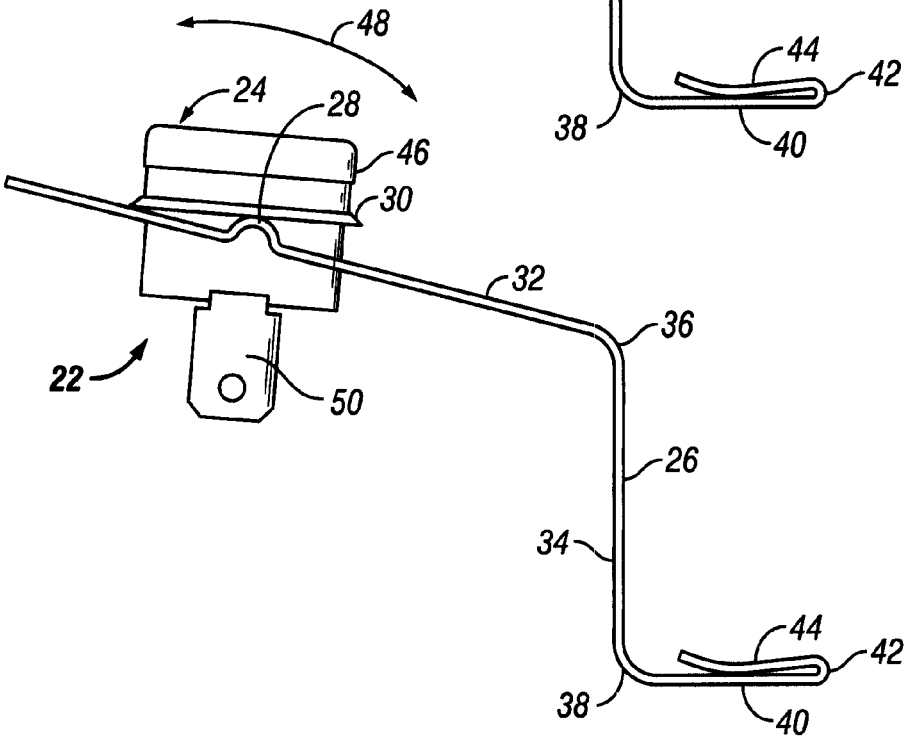
Figure 5:
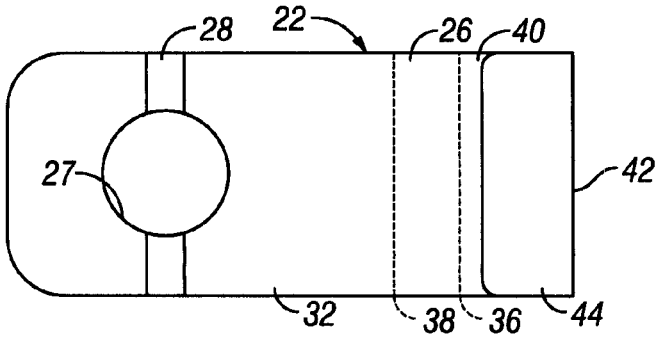
FIG. 5 is a top plan view of the mounting bracket.
Figure 6:
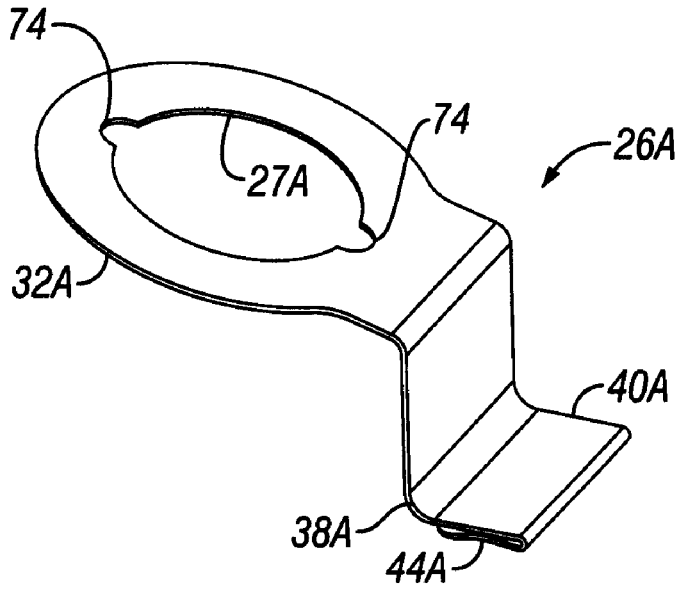
FIG. 6 is a perspective view of a second embodiment for a thermostat mounting bracket.

In one embodiment, shown in FIGS. 2–5, the present invention is directed towards a thermostat assembly 22. The assembly 22 includes a thermostat 24 and a bracket 26. The bracket 26 includes a hole 27 through which the thermostat 24 extends, as seen in FIGS. 3–5. A bead or ridge 28 is formed in the bracket 26 and engages a ring or lip 30 on the thermostat 24 so as to define a pivot axis for the thermostat 24. Thus, the thermostat 24 is pivotally mounted in the hole 27 of the bracket 26 so as to be movable between the positions shown in FIGS. 3 and 4. The thermostat includes electrical contact blades 50 which connect to a conventional power source.

The bracket 26 has a contour to match the shape of the bottom of the tub 12, as seen in FIG. 2. While this shape may vary in accordance with various tub manufacturers, as seen in FIGS. 3 and 4, the bracket 26 includes an arm 32 wherein the thermostat 24 is mounted, a middle portion 34 defined by bends 36, 38, a leg 40, and a 180 degree reverse bend 42 defining a clip 44. The clip 44 is adapted to slide over the edge of the hole 17 in the tub 12 adjacent the pump seal ring. No other fasteners are used to secure the thermostat assembly 22 to the tub 12. The thermostat assembly 22 is mounted on the tub 12 before the pump 16 is installed in the tub. Therefore, the thermostat assembly 22 cannot be removed without first removing the pump 16.

The bracket 26 is preferably made of a resilient or flexible material such as steel. Preferably, the arm 32 is coated with an insulating material to prevent metal-to-metal contact with the stainless steel tub 12. Alternatively, the bracket 26 may be made of plastic or other flexible and resilient material. The resiliency of the bracket 26 applies an upward force on the thermostat 24 to force the thermostat 24 into engagement with the tub 12. The pivotal mounting of the thermostat 24 in the bracket 26 via the bead 28 allows the thermostat 24 to pivot or rock such that the top surface 46 of the thermostat 24 is in substantially flush or flat engagement with the tub 12. The thermostat 24 can pivot between the orientations shown in FIGS. 3 and 4, as indicated by the arrow 48.

An alternative embodiment of the thermostat mounting bracket is shown in FIGS. 6–10 and generally designated by the reference numeral 26A. The thermostat assembly 22A, arm 32A, bend 36A, bend 38A, leg 40A, reverse bend 52, and clip 44A are similar to the corresponding parts numbered without the "A" as shown in FIGS. 3–5. The primary difference between the thermostat mounting brackets 26 and 26A is that the bracket 26A does not include the rib 28, as in the bracket 26. Rather, the rib 28A is formed on an insulator 66 which extends through the hole 27A in the bracket 26A. Since the bracket 26A is preferably made of metal, the insulator 66, made of plastic or other insulating material, is used to prevent direct contact between the bracket 26A and the stainless tub 12.

Figure 7:
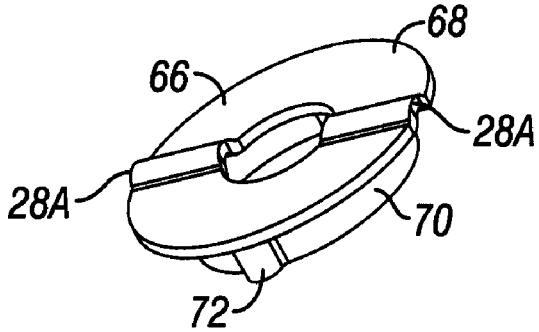
FIG. 7 is a top perspective view of an insulation disk used with the thermostat mounting bracket shown in FIG. 6.
Figure 8:
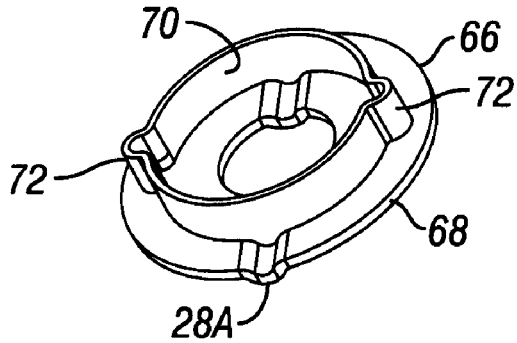
FIG. 8 is a bottom perspective view of the insulation disk shown in FIG. 7.
Figure 9:
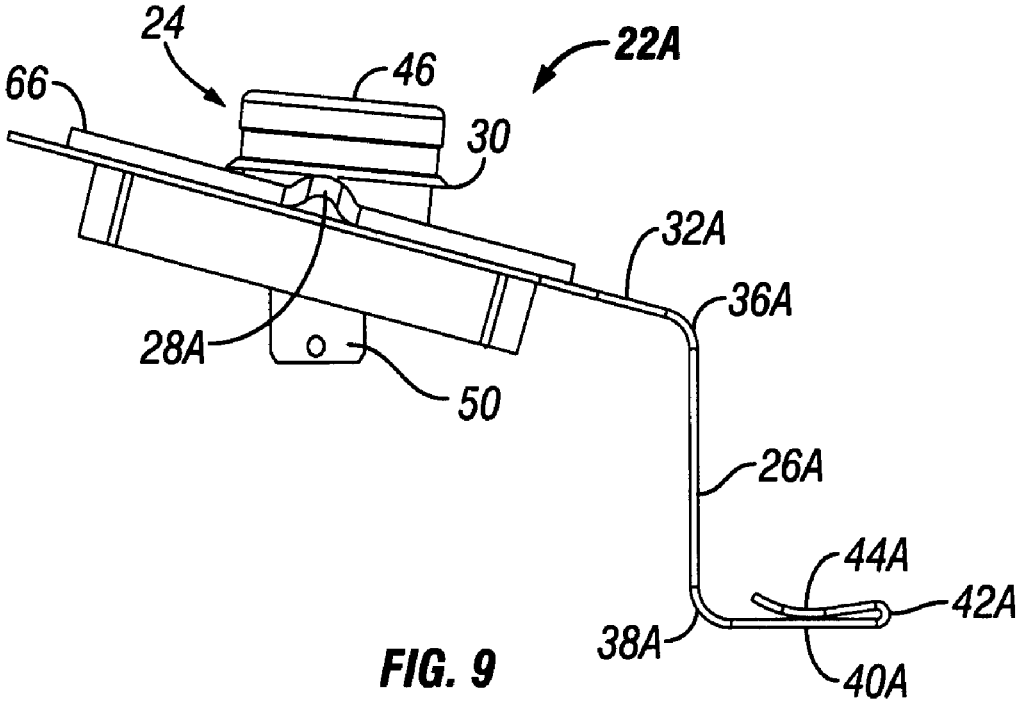
FIGS. 9 and 10 are side elevation views of the thermostat assembly showing alternative pivotal orientations of the thermostat relative to the second embodiment of the thermostat mounting bracket.
Figure 10:
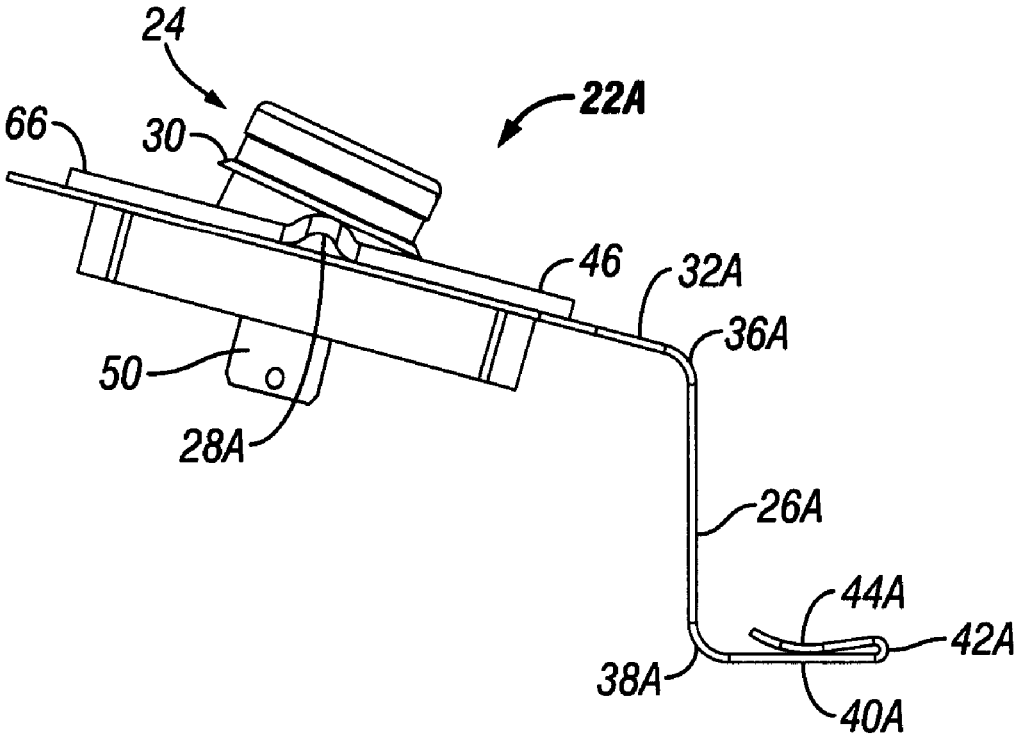
Figure 11:
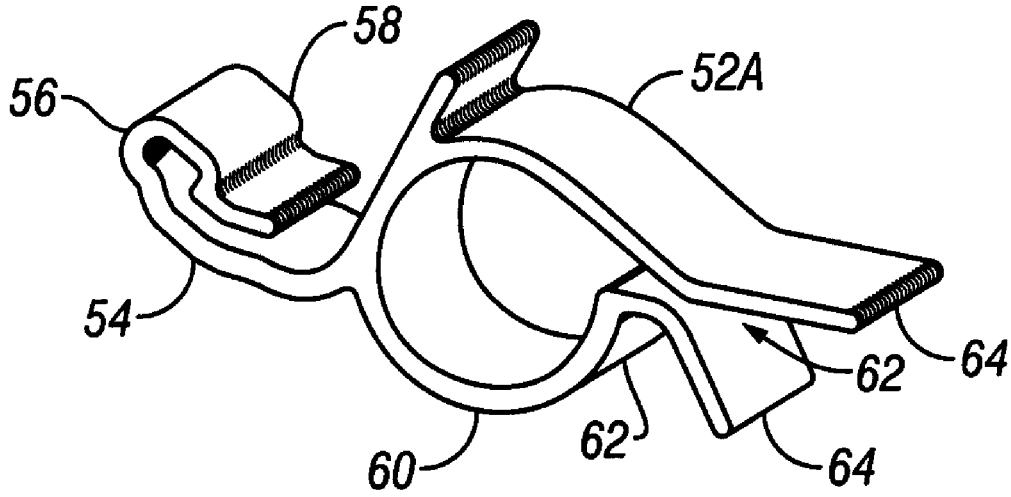
FIG. 11 is a perspective view of one embodiment of the wire harness bracket.
Figure 12:
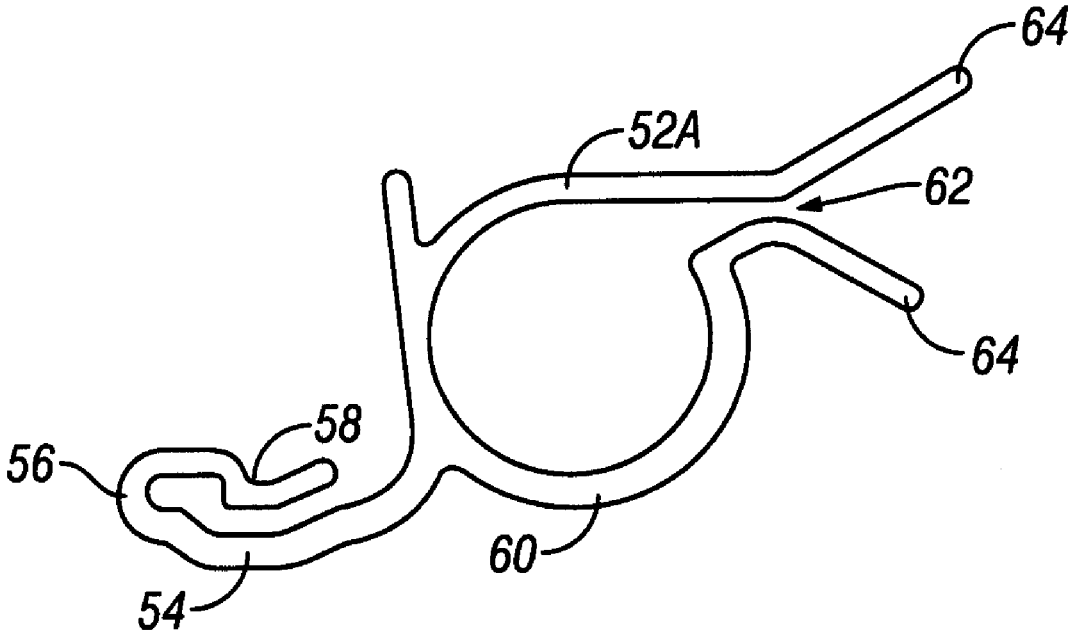
FIG. 12 is a side elevation view of the brackets shown in FIG. 12.
Figure 13:
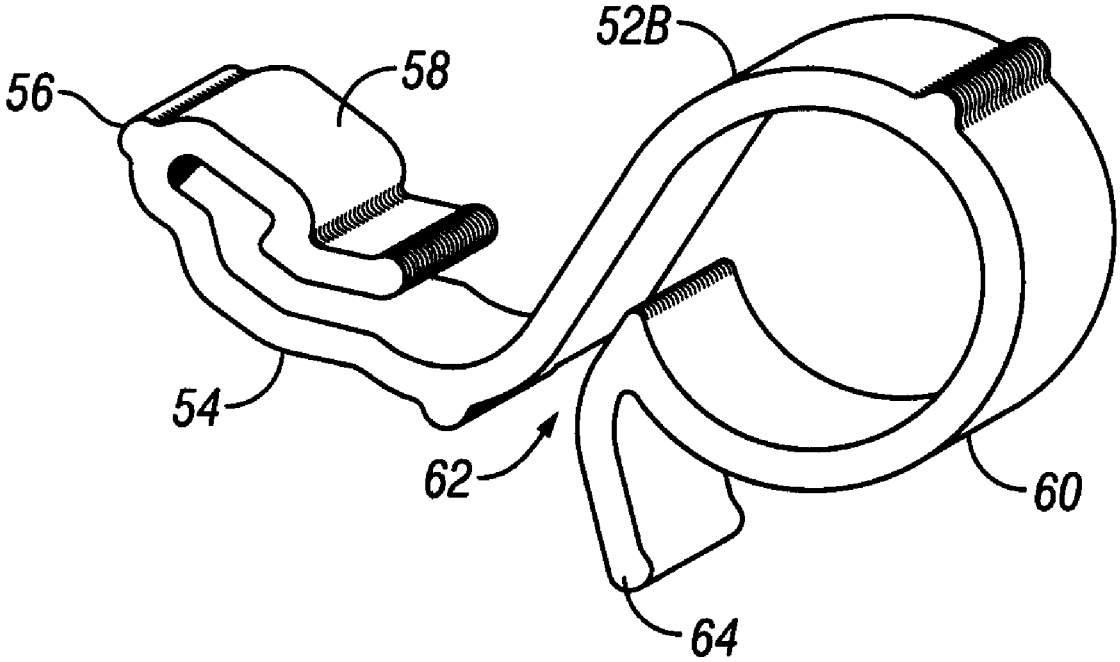
FIG. 13 is a perspective view of a second embodiment of the wire harness bracket of the present invention.

The insulator 66 includes an enlarged head 68 and a short neck 70, as best seen in FIGS. 7 and 8. The bead 28A is formed in the head 68 of the insulator 66. The neck 70 includes a pair of projections 72. The hole 27A in the bracket 26A includes a pair of notches 74 adapted to receive the projections 72 on the neck 70 of the insulator 66, thereby orientating the insulator 66 relative to the bracket 26A. Accordingly, the bead 28A is oriented to allow proper pivotal movement of the thermostat 24 to provide flush engagement between the top surface 46 of the thermostat and the tub 12.

Figure 14:
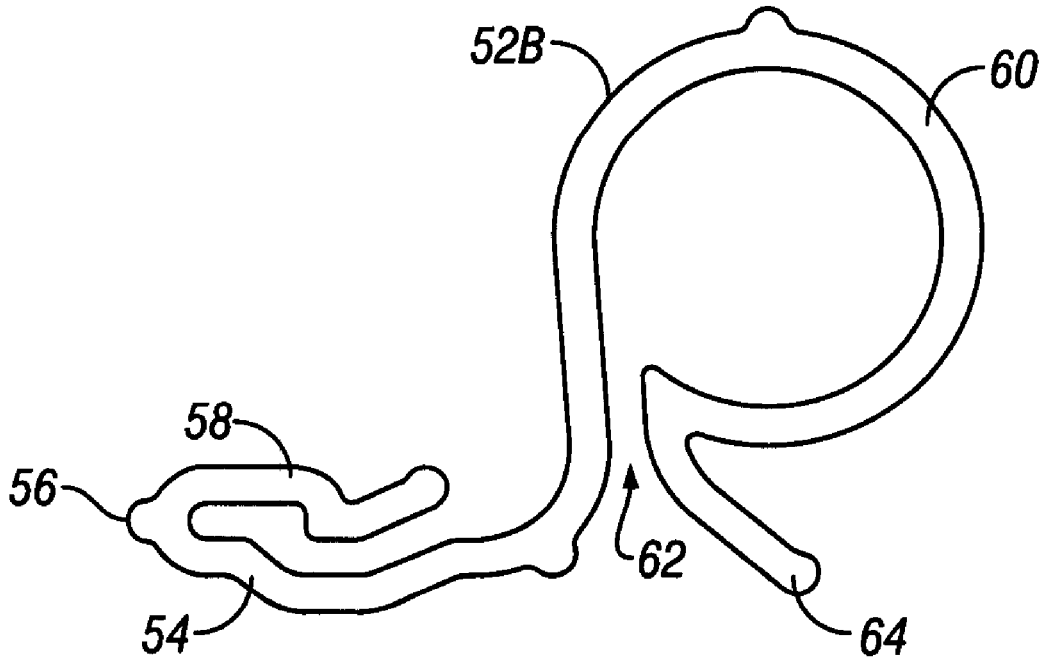
FIG. 14 is a side elevation view of the bracket shown in FIG. 14.

In a second embodiment shown in FIGS. 2 and 14, the invention is directed towards a bracket 52A and 52B to support a wire harness (not shown). Two different embodiments of the wire harness bracket 52A, 52B are shown in FIGS. 11, 12 and 13, 14 respectively. The wire harness brackets 52A, 52B each include a leg 54 with a 180 degree reverse bend 56 defining a clip 58. The leg 54 and clip 58 of the brackets 52A, 52B is adapted to be mounted on the annulus of the hole 17 of the tub 12, in a manner similar to mounting of the thermostat bracket assembly 22.

The brackets 52A, 52B include a loop 60 with an opening 62 therein for receiving the wire harness. The loop 60 terminates in an outwardly flared leg 64 so as to define an entrance notch or funnel into the loop 60 through the loop opening 62.

The primary difference between the brackets 52A and 52B is that the loop opening 62 in the bracket 52A is directed laterally outwardly, while the loop opening 62 in the bracket 52B is directed downwardly.

The brackets 52A and 52B are mounted on the tub annulus 17 before the pump 16 is installed. Thus, the brackets 52A and 52B cannot be removed until the pump is first removed. The wire harnesses can be inserted into the loop 60 before or after the brackets 52A and 52B are mounted on the tub 12.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. In combination with a dishwasher having a tub and a pump extending through an opening in a bottom portion of the tub, and with a sealing ring extending around the opening, a bracket assembly comprising:

a bracket mounted on the tub; and the bracket having a clip for clipping the bracket to an edge of the tub defining the opening; and further comprising a thermostat pivotally mounted on the bracket for engagement with the tub.

2. The combination of claim 1 wherein the bracket has a bead engaging a portion of the thermostat so as to define a pivot axis for the thermostat.

3. The combination of claim 1 wherein the bracket includes an insulation disk having a bead engaging a portion of the thermostat so as to define a pivot axis for the thermostat.

4. The combination of claim 1 wherein the assembly is free from additional mounting fasteners.

5. The combination of claim 1 wherein the bracket is mounted on the seal ring.

6. The combination of claim 1 wherein the bracket is flexible.

7. The combination of claim 1 wherein the clip is integrally formed on the bracket.

* * * * *